US005154461A

United States Patent [19]

Prescott et al.

[11] Patent Number: 5,154,461

[45] Date of Patent: Oct. 13, 1992

[54] DOOR SECURED SYSTEM

[76] Inventors: Joseph G. Prescott, 4440 Tall Trees Cove; James M. Matheis, 72 E. Charlotte Cir., both of Memphis, Tenn. 38117

[21] Appl. No.: 491,283

[22] Filed: Apr. 27, 1990

[51] Int. Cl.[5] ..... E05B 63/00

[52] U.S. Cl. ..... 292/346; 292/340; 292/272; 292/DIG. 17; 49/503

[58] Field of Search ..... 292/DIG. 17, 340, 269, 292/262, 272, 346; 49/503; 40/417

[56] References Cited

U.S. PATENT DOCUMENTS

| | | | |
|---|---|---|---|
| 197,577 | 11/1877 | Whipple | 292/269 |
| 940,362 | 11/1909 | Ritchel . | |
| 1,245,302 | 11/1917 | Ziehler | 292/DIG. 17 |
| 1,548,744 | 8/1925 | Pratt | 292/269 |
| 3,764,173 | 11/1973 | Griffith . | |
| 3,767,248 | 10/1973 | Kefee | 292/340 |
| 3,819,216 | 6/1974 | Richardson . | |
| 3,888,530 | 6/1975 | Fabrill | 292/346 |
| 3,955,841 | 3/1976 | Walker | 292/262 |
| 3,980,330 | 9/1976 | Walker | 292/262 |
| 4,057,274 | 11/1977 | Van Gompel . | |
| 4,139,999 | 2/1979 | Allenbaugh . | |
| 4,281,479 | 8/1981 | Daus | 49/503 |
| 4,330,147 | 5/1982 | Nolen . | |
| 4,416,087 | 11/1983 | Ghatak . | |
| 4,429,911 | 2/1984 | O'Neal et al. | 292/272 |
| 4,529,235 | 7/1985 | Florentine, Sr. . | |
| 4,635,399 | 1/1987 | Gehrke et al. . | |
| 4,763,499 | 8/1988 | Boyle | 70/417 |
| 4,953,901 | 9/1990 | Hegdahl | 292/340 |

FOREIGN PATENT DOCUMENTS

| | | | |
|---|---|---|---|
| 1427827 | 2/1976 | United Kingdom | 292/346 |

*Primary Examiner*—Eric K. Nicholson

[57] ABSTRACT

A door secured system includes a door reinforcing rigid metal member (20) across the width of a presently installed door or imbedded within the construction of a new door (20*a*) to prevent the breaking in of the center of th edoor (panel, rails, etc.) having an L-shaped end at the strike area (24) to strength the lock and strike area. On a presently installed door, fingers (26, 26*a* & 26*b*) at the hinge side of the reinforcing rigid metal member (20) with a special hinge (28 and 30) and pin (27) combination five added strength to the hinge system. This also allows easy removal on special occasions. The reinforcing rigid metal member (20*a*) within the construction of a new door has an L-shaped end (62) for securely attaching a hinge plate (not shown), giving added strength to the hinge side of the door. The rigid metal member (20+20*a*) has an opening (22) to encompass a cylindrical door lock assembly (46) or dead bolt lock assembly (44). These systems give the same security when in or away from the dwelling. A strike plate (48, 48*a* or 48*b*) and hinge plate (30) are to extend a distance so as to permit screws (34) to penetrate not only into the jambs, which generally is the case, but also into the wall studs (38 & 38*a*). A door-peep strike plate (48*b*) permits the door to open far enough to see, hear, and talk to someone on the other side and pass articles through without unlocking the dead bolt lock (44). assuring safety. A reinforcing rod (40) penetrates through the edge of the door (42), both hinge plates (28 and 30), door jamb (36) and into the stud (38), preventing the removal of the door, while locked, if the hinge pins are removed. This also gives additional resistance and support strength in the hinge arear (28 & 30).

11 Claims, 13 Drawing Sheets

DOOR SECURED SYSTEM

BACKGROUND-FIELD OF INVENTION

This invention relates to the field of building or house doors and more particularly to the field of door security systems for the prevention of unauthorized ingress and egress, through a locked door.

BACKGROUND-DESCRIPTION OF PRIOR ART

Heretofore, various individuals have focused on one trouble spot to the exclusion of others. If the door jamb was strengthened, then the door lock region was the weak point. If the lock only was strengthened, then the door jamb and trim would give way to a crash-in. Attempts made to cover these two areas left the center of the door and hinge areas vulnerable. There is a great need for providing strength and security at the jamb, trim, lock and hinge areas, and the center of door.

Heretofore, there has been a dire need for much more security at reasonable cost. To illustrate, many people buy strong, beautiful and expensive entrance doors and then cover or camouflage the door with expensive wrought iron doors, which are vulnerable to a crowbar, etc. Police report that 70 plus percent of forced entries are kick-ins. Crowbars or other prying tools are used, including jacks that spread the jambs, thus allowing entry.

Heretofore, some systems, example: U.S. Pat. No. 3,764,173, 1973, to Griffith, give some protection to the door lock side and the door jamb, but are not designed to strengthen the center of the door, and the hinge area. Therefore, they do not protect from crashing through the center or hinge side of the door. Many exterior doors are hollow core and some are made up of panels and rails. These can easily be broken through in the middle of the door. The typical door installation and locking devices give little or no protection against such breaking in. The hardware with the typical lock is wholly inadequate. The strike plates are thin. The screws are short and of small diameter. A quick kick or body lunge will cause the door, the jamb and the trim to give way.

Other systems, such as U.S. Pat. No. 4,416,087, 1983, to Ghatak, are designed to reinforce the door jamb only on the lock side of the door. Ghatak's assembly requires four (4) holes to be bored into the jamb, all in close proximity of the strike plate aperture. This weakens the jamb in an area where more strength is needed. Ghatak's patent has nothing to strengthen the door lock area. Likewise, as in Griffith's patent, neither is designed to prevent a break through the middle of the door or the hinge side. U.S. Pat. No. 4,635,399, 1987, to Gehrke et al, is for the door jamb only on a lock side. Nothing is provided for the door lock area, and nothing is provided to strengthen the center or the hinge side of a door. The jamb support is attached to the jamb without screws going on through the jamb and into the stud. A strong kick can splinter the jamb, the door and the trim. While U.S. Pat. No. 4,139,999, 1979, to Allenbaugh, gives added strength to the door in the vicinity of the door lock, no protection is given for the door jamb; and as in Ghatak, Gehrke et al and Griffith, no protection is given for the center and vulnerable part of the door, as well as the hinge side.

U.S. Pat. No. 4,330,147, 1982, to Nolen shows a bar across the door, which can only be used as he stated, "when the user is inside of his or her dwelling". Further, it is installed on the door jamb. Like all prior art mentioned, no screws or other means are provided for attachment to the strong stud. A quick kick can break out the door jamb and the trim. This system also requires considerable manipulation and time to release in case of fire or other needs for a quick exit. Further, because there are, of necessity, connections between the bars and the assorted frame mounted structures, the entire devices are generally weak at these points, thereby rendering the whole assembly susceptible to attack.

U.S. Pat. No. 4,529,235, 1985, to Florentine, Sr. as he pointed "relative to bolting of doors for a prolonged period of time", can not be used for every day in and out activity.

U.S. Pat. No. 4,057,274, 1977, Van Gompel, uses an L-shaped bracing bar. The object is to provide security to a storage area, and is not practical or adaptable to residences. It can only be removed after installation "with proper tools" as stated in his patent.

U.S. Pat. No. 3,819,216, 1974, to Richardson, is a burglary bar for outswinging doors. It uses a padlock. Padlocks can easily be cut with bolt cutters. Bars such as this are unsightly and would not be adaptable to residences, inasmuch as residential doors swing inward.

U.S. Pat. No. 940,362, 1909, to M. Ritchel, is also unsightly. It cannot be removed, if owner desires, for special occasions as parties. It is attached to the trim, which would easily give way to a kick-in or crash through.

Heretofore, peep or see-through apparatuses on the market consisted of a chain, rod, or circular opening in the face of a door to look through. The chain and rod are attached by means of $\frac{5}{8}''$–$\frac{3}{4}''$ length screws in the door and the door trim. They give little protection while occupant opens the door far enough for recognition or talking to someone outside. So there is a dire need for a door-peep system that will protect an individual when answering the door to a stranger.

Therefore, there is a need for a means to give added strength to the door jamb on both the lock and the hinge side, to reinforce the lock area of the door, and to reinforce the center of the door to make it less conducive to splintering and/or breaking through. Police report that when burglars cannot quickly get through a door, they try a window, and then take items out through a door by removing the hinge pins.

For even those residences which have steel doors, there is no protection for both the lock side and the hinge side jambs and the trim areas.

In the past 60 days in Memphis alone, two people were raped and killed as a result of an intruder breaking through a bedroom door. Our Door Secured System installed on an interior door would have been a great deterrent.

OBJECTS AND ADVANTAGES

Accordingly, several objects and advantages of our invention are:

(a) To provide a door security system that reinforces and strengthens a door lock, while in or out of the home.

(b) To provide a door secured system that reinforces and strengthens the jamb on both the lock and the hinge sides.

(c) To provide a door secured system that reinforces and strengthens the center of the door itself, and prevents entry by kicking in and then taking furniture and other valuables through the door.

(d) To provide a door secured system that stays in place while at home or away from home.

(e) To provide a door secured system that allows a person to open the door far enough to see, hear and talk to a person without unlocking a dead bolt lock or other lock.

(f) To provide a door secured system that is easily and inexpensively installed on new and old door openings by a professional, redi-hung door manufacturer, locksmith, trim man or a do-it-yourselfer.

(g) To provide a door secured system that can be removed readily and stored out of sight if desired on special occasions, such as parties.

(h) To provide a door security system that can be decorated to match the paint or stain of a door or can be decorated with contrasting patterns, or can be made virtually invisible within construction of a flush door.

(i) To provide a door security system that can be installed on interior doors as well as on exterior entrance doors.

(j) To provide a door security system that can be applied to cylindrical and dead bolt locks and give the same security for every room within a home.

(k) to provide a door secured system that may be installed on special doors, such as glazed doors and doors having molding on the surface.

(l) To provide a door security system that will give ample security without hiding or camouflaging a beautiful and expensive door.

(m) To provide a door secured system that will prevent unlawful intruders who enter a building through a relatively unsecured window, or the like, and then removing the hinge pins to gain both ingress and egress to remove valuables.

(n) To provide a door secured system which is particularly adaptable for hollow core doors, that have little support in their structure.

(o) To provide a door secured system which is simple in design, inexpensive to manufacture, rugged in construction, easy to use and secure in operation. Further objects and advantages of our invention will become apparent from a consideration of the drawings and the ensuing description of it.

DESCRIPTION OF DRAWINGS

In the drawings, closely related figures have the same number but different alphabetical suffixes.

FIG. 8*d* shows an elevation view of a door jamb hinge plate.

REFERENCE NUMERALS IN DRAWINGS

Figure 4:
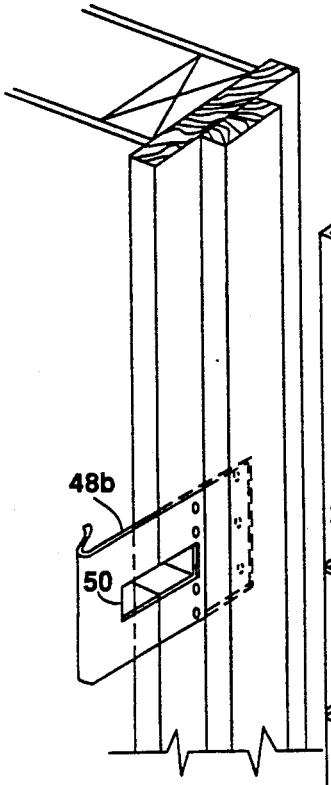
FIG. 4 shows a perspective view of a door-peep strike plate mounted on a door jamb lock side.

20 reinforcing rigid metal member
20*a* reinforcing rigid metal member imbedded in the core under the overlay.
21 door
22 door lock assembly opening
23 headless screw 24 bend of reinforcing rigid metal member on the lock side
25 screw
26*a* top finger on plate
26*b* center finger
26*c* lower finger
27 extended hinge pin
28 half 3 knuckle hinge with center knuckle removed
29 center knuckle removed
30 door jamb hinge plate
31 L-shaped extended hinge plate
31*a* indicates place where 31 may be bent to fit wall
32 door stop
34 flat head screw
35 countersunk screw hole
36 door jamb at hinge side
36*a* door jamb at lock side
38 stud, hinge side
38*a* stud, lock side
40 reinforcing rod
42 rod aperture
44 dead bolt lock
45 hinge pins
46 door knob of cylindrical lock
48 dead bolt strike plate
48*a* combination strike plate
48*b* door peep strike plate
50 door peep strike plate opening
51 strike opening
52 elongated countersunk holes
53 elongated countersunk hole, with center enlarged to receive a screw head
54 curved portion, door peep strike plate
55 interior trim member
56*a*, 56*b* points of dead bolt travel
58 indicates place where door peep strike plate may be cut to have less width of protrusion
59 indicates place where reinforcing rigid metal member may be cut for alternate installation
60 indicates place where door-peep strike plate may be cut to have rounded corners
61 surface overlay
62 hinge end of imbedded reinforcing rigid metal member
63 strike end of reinforcing rigid metal member
64 core section
65 L-shaped strike plate
66 bend in L-shaped strike plate
68 exterior trim member
70 one way screw
72 fingers on extended hinge plate
74 fingers on extended strike plate

DESCRIPTION

FIGS. 1 to 18

Figure 1:
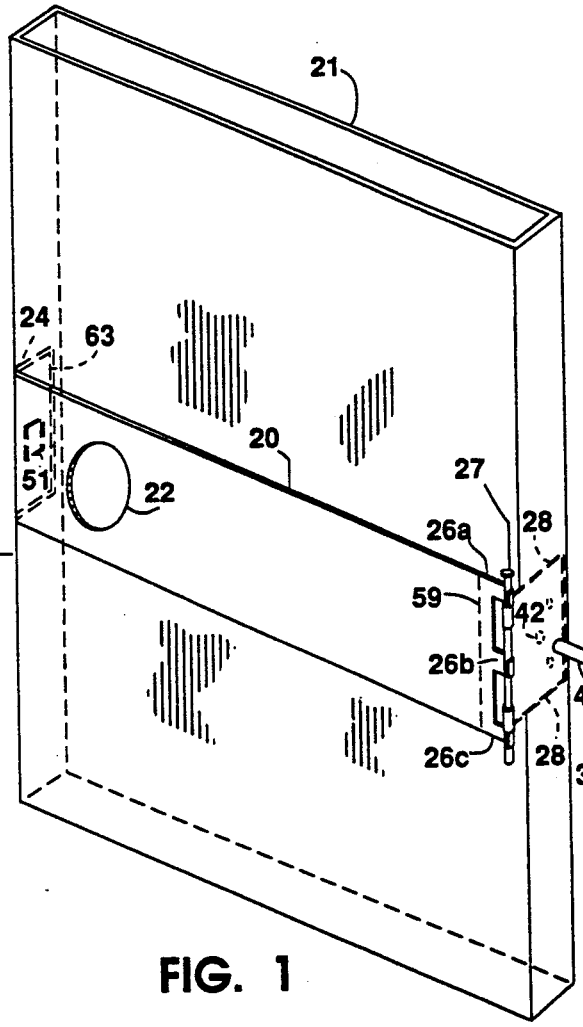
FIG. 1 shows a perspective view of a reinforcing rigid metal member and a hinge plate installed on the inside of a door.
Figure 2:
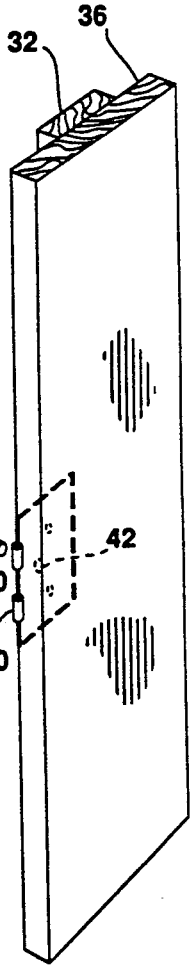
FIG. 2 shows a perspective view of a two-knuckle hinge plate installed on a door jamb.

A typical embodiment of the door secured system of the present invention is illustrated in FIGS. 1, 2 & 4 perspective views of the various parts. FIG. 1 shows a perspective view of a reinforcing rigid metal member 20 which wraps around a strike edge 24 of a door 21 forming a strike plate 63 with a strike plate opening 51 also shown in FIGS. 9, 10, & 10*a*. The metal member 20 is secured to the door 21 with a No. 10 by ½ inch or equivalent flat head screw 25, FIG. 9, and two or more headless screws 23, as shown in FIGS. 9 and 10*a*, over a lock strike plate (not shown). The metal member 20 extends across a door 21 to a hinge side. The reinforcing rigid metal member 20 may be of various shapes and designs etc., made of various materials, such as brass, etc. and decorated to match or contrast with the door 21. In one embodiment, the hinge end of the metal member has three fingers 26*a*, 26*b* & 26*c*, as shown in FIG. 8*a*, which wrap partially around a special length hinge pin 27. This system allows for a slight variation in the width of the door. It also provides additional strength, resisting break-ins.

Figure 11:
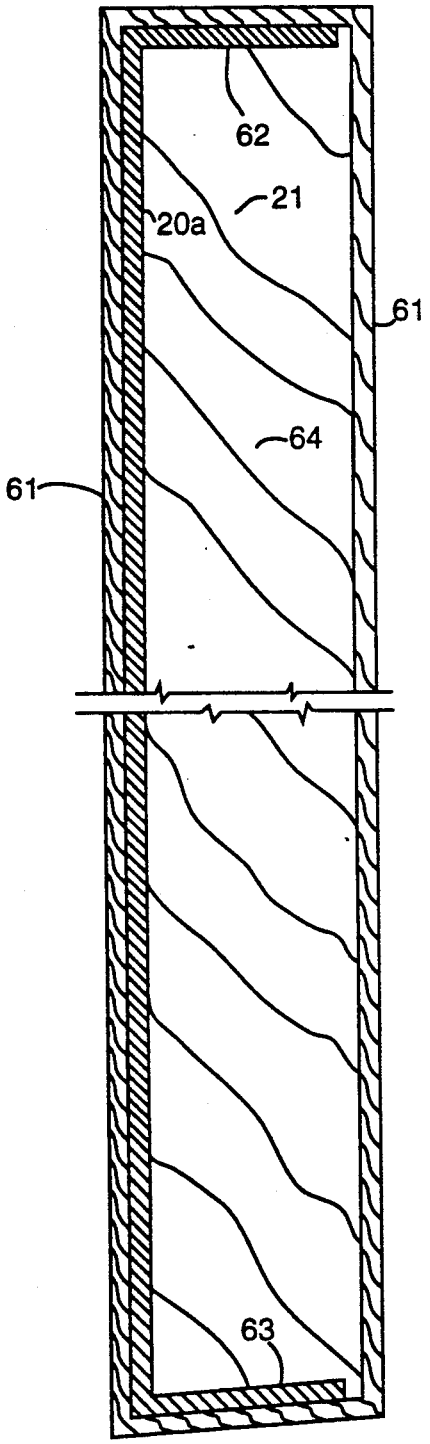
FIG. 11 shows a top cross section view of the reinforcing rigid metal member inserted in a core section of the door, showing both the hinge end and the strike end.
Figure 12:
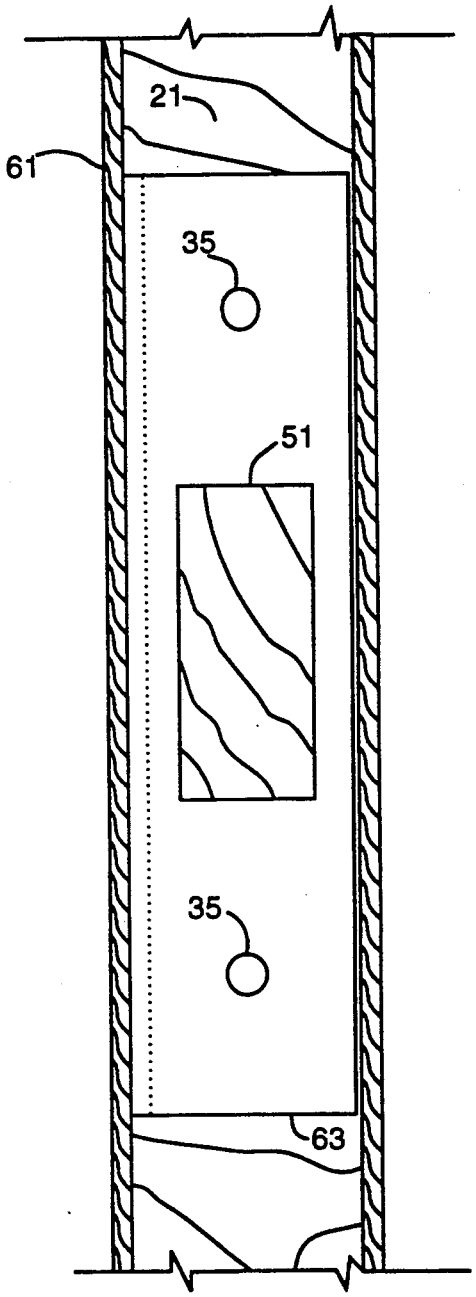
FIG. 12 shows an end elevation view of the door strike area of the reinforcing rigid metal member, inserted under a surface overlay of the door showing a strike plate opening and one of several possible screw arrangements.

In an alternate embodiment, the member 20 is cut at 59 and secured to the hinge side of the door by an attachment means such as flat headed beveled screws 25, but not limited to these. Elongated countersunk holes 53, with their centers enlarged to receive the head of the screws 25, allows metal member 20 to be used either for a right-handed or left-handed door. Another method of securing the metal member 20 is shown in FIGS. 11 and 12, wherein the metal member 20*a*is placed under a surface overlay 61 of a conventional flush door 21 during manufacturing. The strike end 63 is embedded within the door 21 to permit a dead bolt with an attached strike plate, not shown, to be installed and secured to the door 21 at a strike opening 51. The hinge 28 & 30 is installed by pre-drilling holes at a hinge end 62 for the screws 34.

Figure 13:
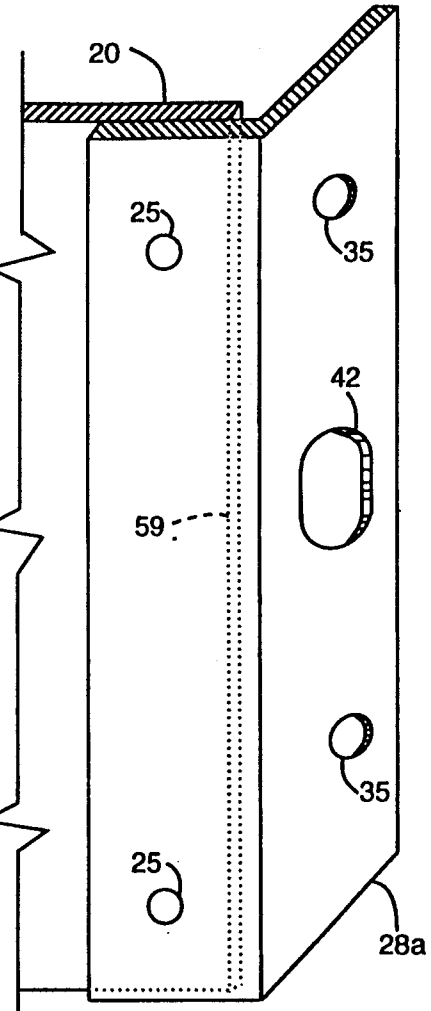
FIG. 13 shows a perspective view of an L-angle rod plate over the end of the metal member.

In an alternate embodiment, FIG. 8*a* and FIG. 13, the reinforcing rigid metal member 20, cut at 59. It is secured to the hinge side of the door by an attachment means such as flat headed beveled screws 25 in elongated countersunk holes 53, either for right or left handed doors.

Figure 3:
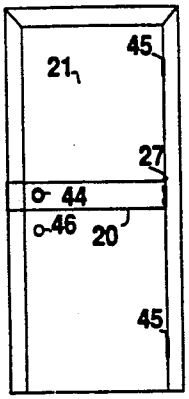
FIG. 3 shows a front elevation view of a door assemble showing the reinforcing rigid metal member installed over a dead bolt lock.
Figure 7:
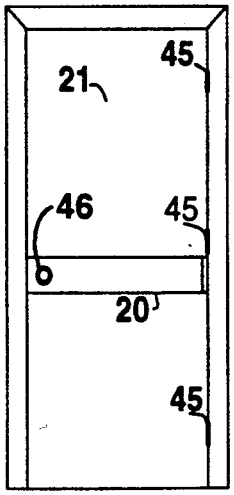
FIG. 7 shows a front elevation view of a door assembly cylindrical lock and knob. showing the reinforcing rigid metal member installed over a cylindrical lock and knob.
Figure 10:
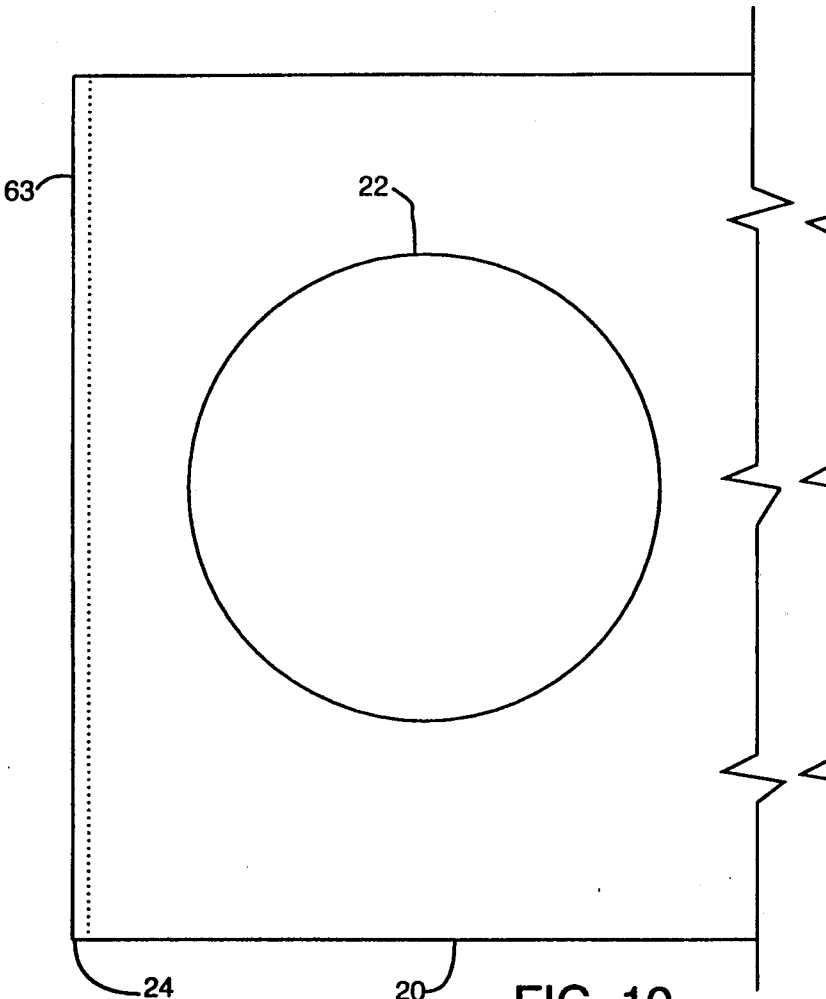
FIG. 10 shows a front elevation view of the lock end of reinforcing rigid metal member showing an opening to receive a cylindrical door lock knob or a dead bolt lock.
Figure 10A:
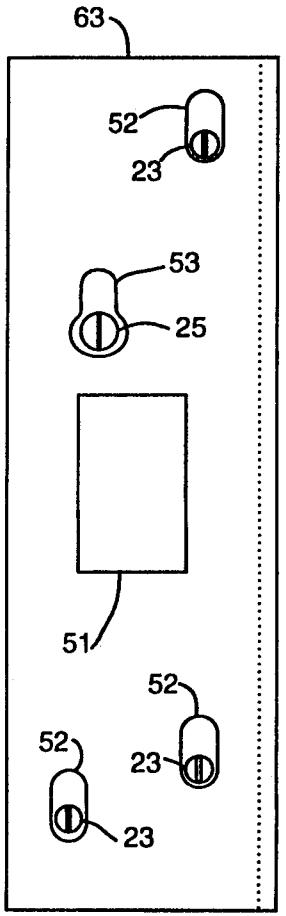
FIG. 10*a* shows an end elevation view of the door strike area of the reinforcing rigid metal member, showing a screw arrangement for easy removal of the metal member.

The metal member 20 contains a hole 22 of FIGS. 1 & 10 of sufficient dimension to give clearance to fit over a dead bolt lock 44, FIG. 3 or a door knob assembly of a cylindrical lock 46, FIG. 7. Thus this door secured system is designed for both interior and exterior doors.

Figure 8:
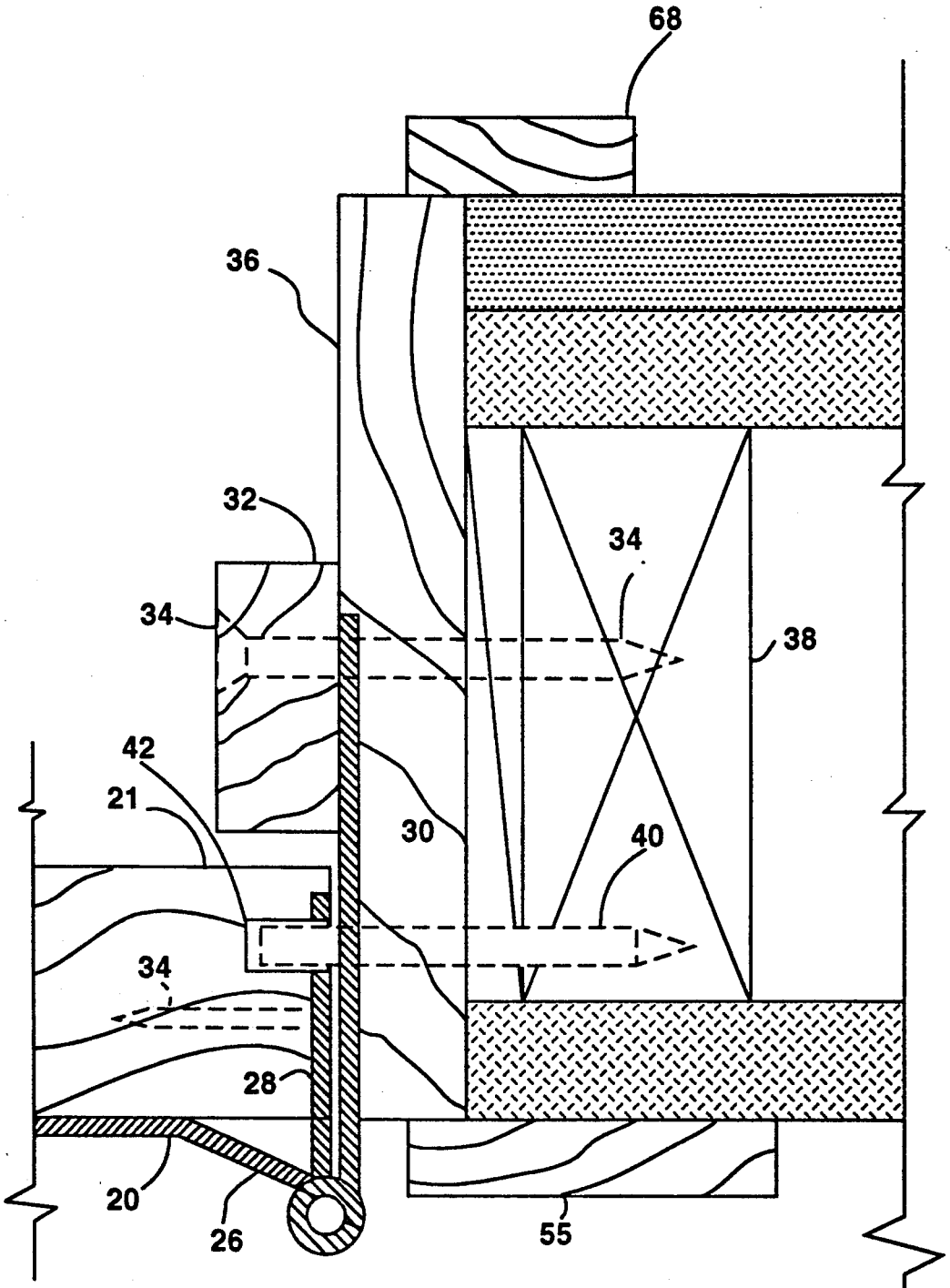
FIG. 8 shows a top cross section view of the hinge end of the reinforcing rigid metal member, a special hinge and a reinforcing rod attached through a door jamb and into a wall stud.
Figures 8A, 8B, 8C, 8D, 8E:
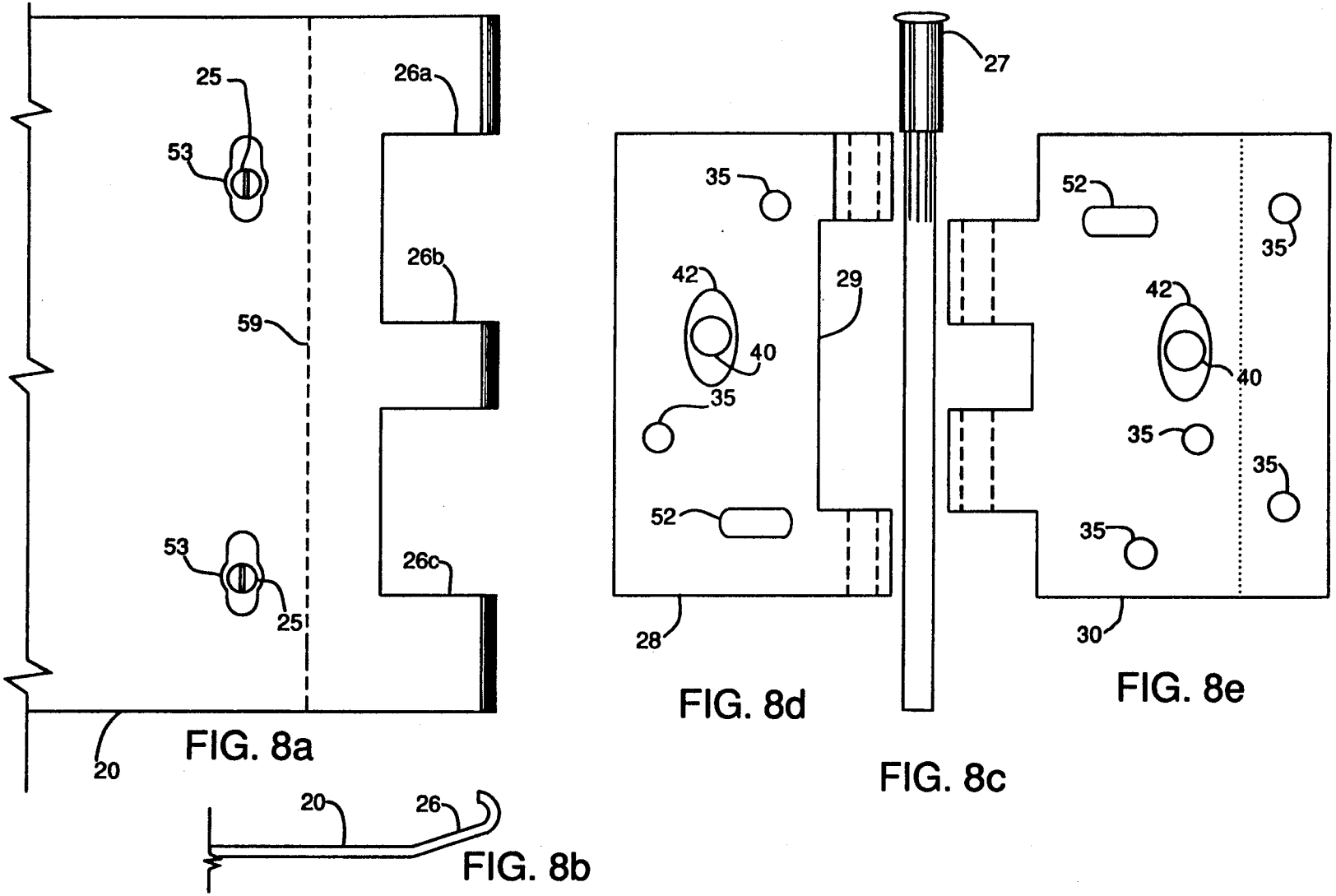
FIG. 8*a* shows an elevation view of the fingers at the hinge area of the reinforcing rigid metal member.
FIG. 8*b* shows a top cross section view of the fingers at the hinge area of the reinforcing rigid metal member.
FIG. 8*c* shows an elevation view of an extended hinge pin.
FIG. 8*d* shows an elevation view of a special two-knuckle door half hinge.
Figure 9:
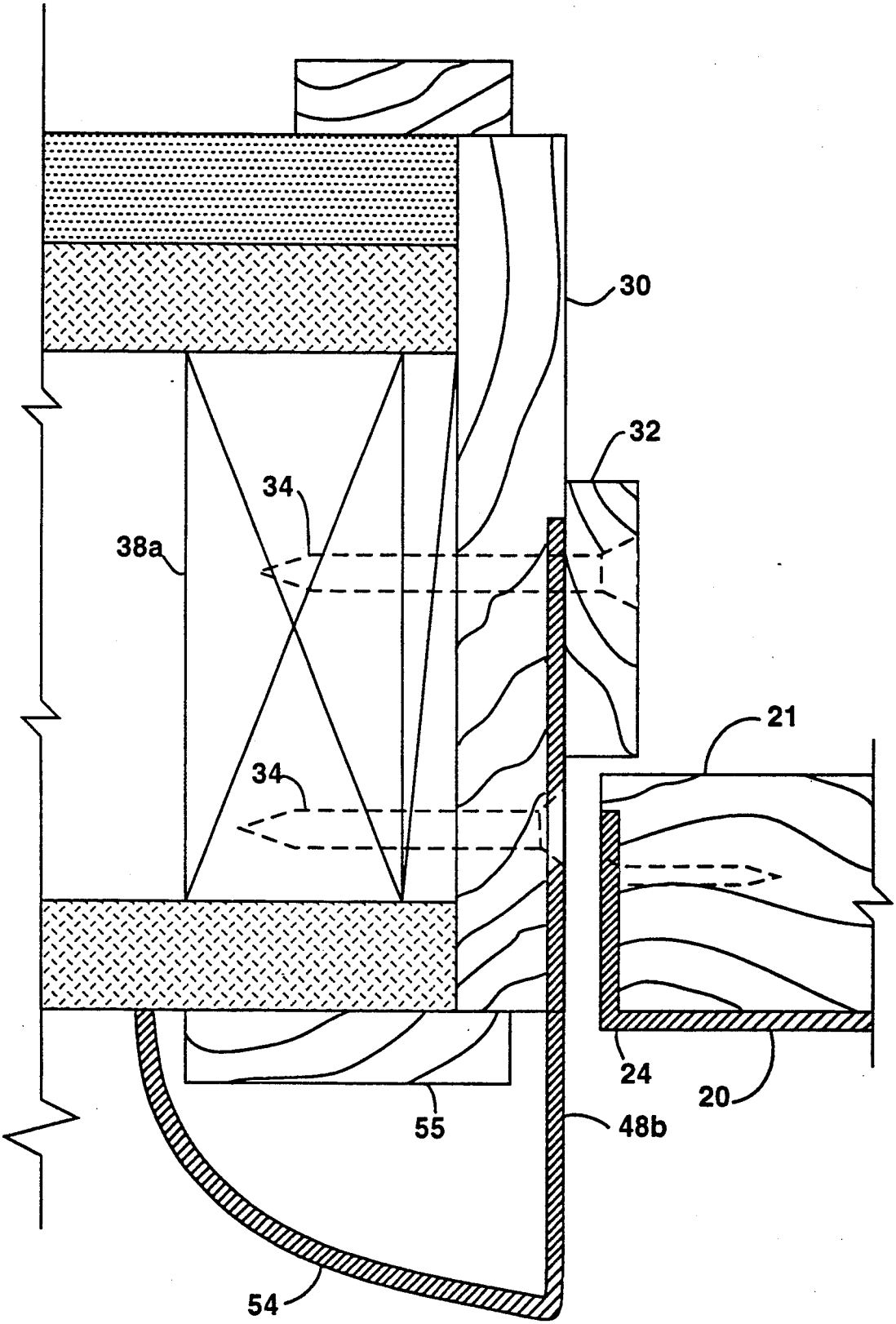
FIG. 9 shows a cross section view of the lock end of the reinforcing rigid metal member mounted on the door with the door closed, and the door peep strike plate attached to the jamb and a stud.

In FIGS. 8 and 8*d*, a special two-knuckle half hinge 28 is mounted on the door 21 by screws 34 of size No. 10×2½ inches or the equivalent, but not restricted to this size. The half hinge 8 is like a three-knuckle half hinge with the center knuckle 29 removed. This allows clearance to receive the center finger 26*b* of the metal member 20.

In another embodiment, a standard half hinge 28 is used without the center knuckle 29 removed. The metal member 20 has only two fingers 26*a* and 26*c*, which wrap partially around the hinge pin 27 above and below the hinge 28 and 30.

Also in FIG. 8*e*, the jamb hinge plate 30 is extended to allow the screws 34 of sufficient length to penetrate through countersunk screw holes 35 and not only a door jamb 36, FIG. 8, but also through a shimmed area, if any, and into a stud 38.

The screws 34 have deeper threads than wood screws, thus adding more horizontal-outward from the door-holding power and greatly minimizing the prying away of the jamb from the lock bolt. Many times the space between the jamb 36 and the stud 38 are not shimmed sufficiently to prevent prying apart. While not essential to the present invention, metal screws are recommended, which have deeper threads up to the head. This type screw is also used on the hinge side. While not essential to the present invention, the applicants also recommend that the screws 34 be inserted into the studs through the jambs a distance above and below the lock area and the center hinge on the hinge side. Thus the jambs are strengthened against both prying away from the door and splitting upon horizontal thrusts and kick-ins.

Figure 14:
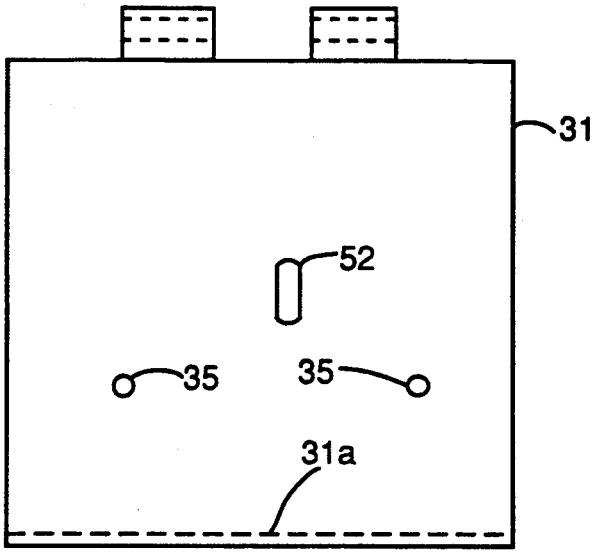
FIG. 14 shows a front elevation view of an L-shaped extended hinge plate.
Figure 15:
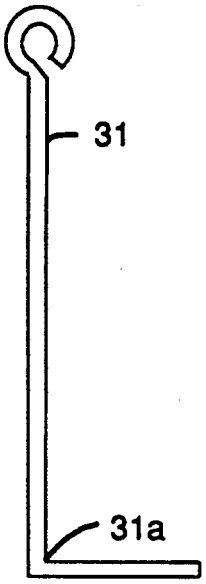
FIG. 15 shows a top cross section view of an L-shaped extended hinge plate.
Figure 18:
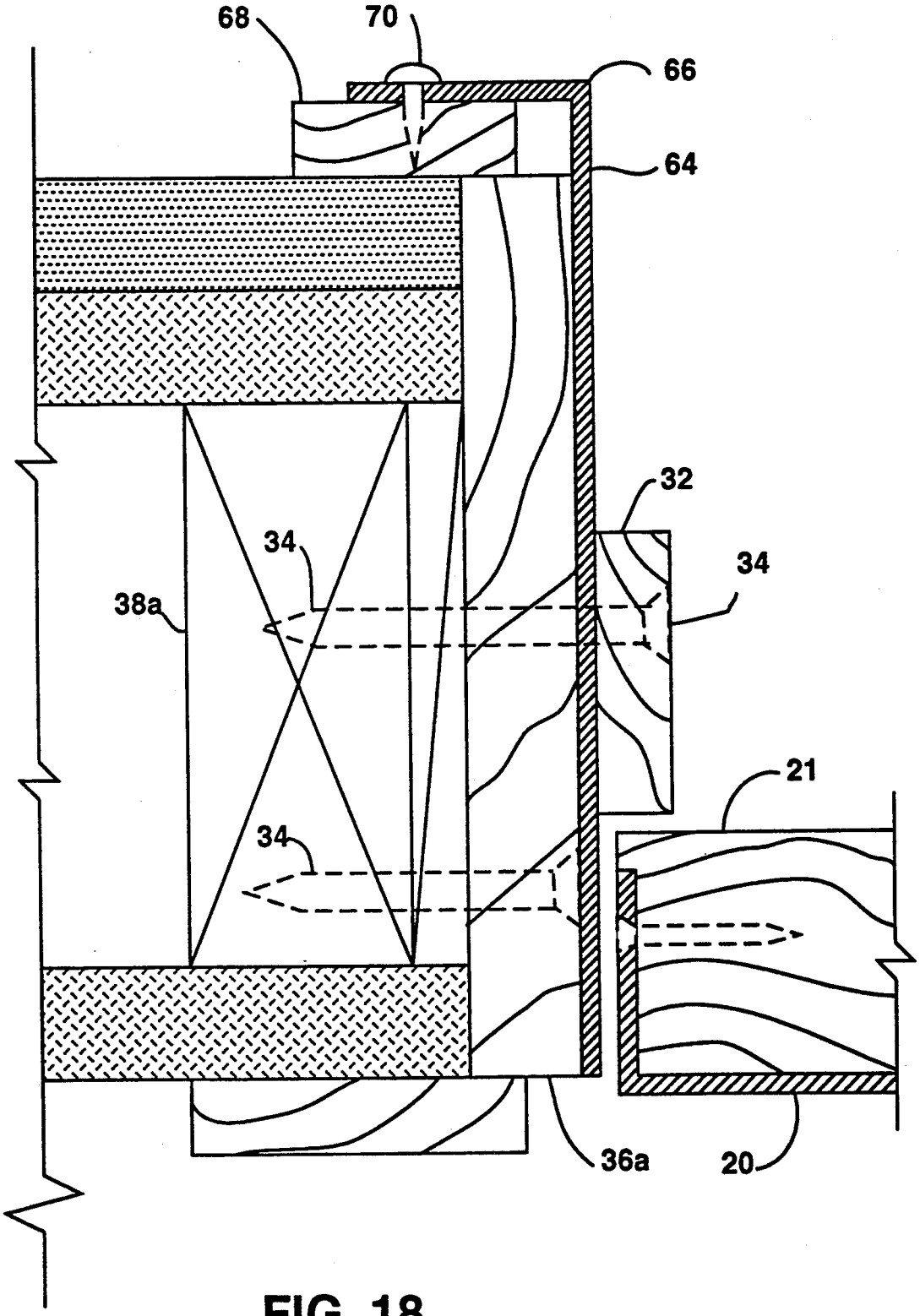
FIG. 18 shows a top cross section view of the L-shaped extended strike plate installed on the strike side jamb.

In another embodiment, FIG. 14 shows an, L-shaped extended hinge plate 31, which wraps around the jamb 36, FIG. 8, for added strength. The plate 31 can be bent at 31*a* when installed to fit various wall thicknesses. That portion of the L-plate 31 wrapped around the exterior trim 68 is secured to the wall with a one-way screw 70. The screws 34 also penetrate, not only the door stop 32, and/or jamb 36*a* but also into the stud 38*a*, as illustrated in FIG. 18, L-shaped strike plate As in FIG. 16, a set of fingers 72 can be easily formed and adjusted on the job so as to fit the individual installation.

Also in FIG. 8, a threaded reinforcing rod 40 is inserted through the door jamb hinge plate 30, the jamb 36 and into the stud 38. The rod 40 extends a distance from the door jamb hinge plate 30, so when the door 21 closes, the rod 40 penetrates through an opening 42 in both the hinge plate 28 and the door 21.

Thus this system, with a double keyed dead bolt lock 44, prevents both ingress and egress through the door 21 even though the hinge pins 27, FIG. 1, and 45, FIGS. 3 & 7, are removed. This system also adds tremendous strength to the hinge side, thus resisting kick-ins.

FIG. 10*a* shows an end elevation view of the metal member 20 strike plate 63. Elongated screw holes 52 & 53 allow the metal member 20 to be raised a small distance so that it can clear the head of a screw 25, swing out away from the door 21, and be removed. One part of the elongated beveled screw hole 53 is enlarged so that the metal member strike plate 63 could pass over the head of the standard flat head screw 25. The screw head 25 holds the metal member 20 with strike plate 63 firmly in position when the door 21 is closed or open. Headless screws 23 are flush with the face of the strike plate 63 and hold the metal member 20 firmly in place to prevent the kicking in of the door 21. This system provides the flexibility of remaining in place at all times or being removed and stored out of sight upon special occasions if desired.

Figure 4A:
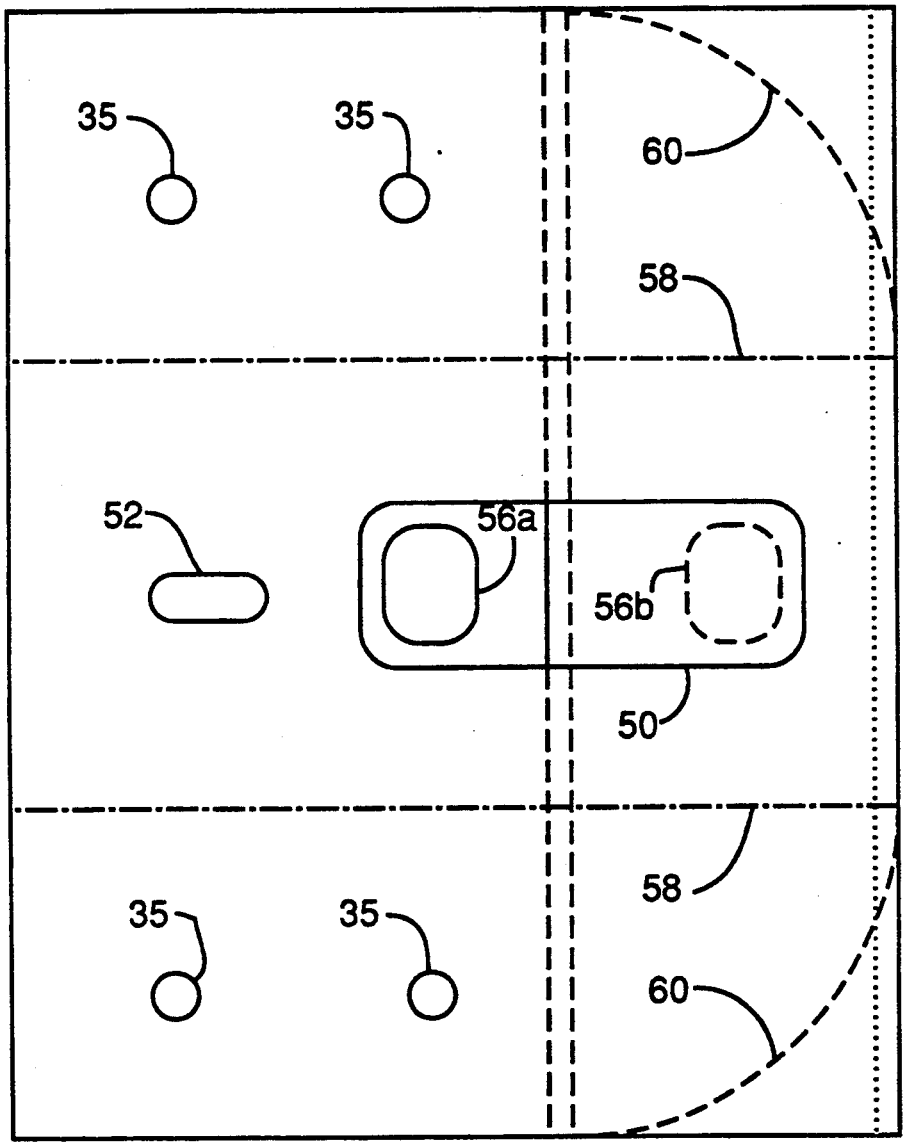
FIG. 4*a* shows an elevation view of the door-peep jamb strike plate.
Figure 5:
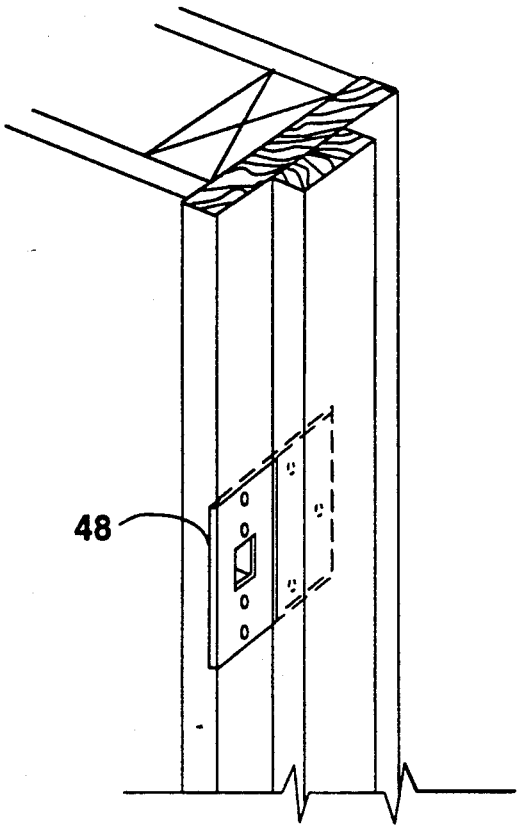
FIG. 5 shows a perspective view of a door jamb strike plate for a dead bolt lock.
Figure 6:
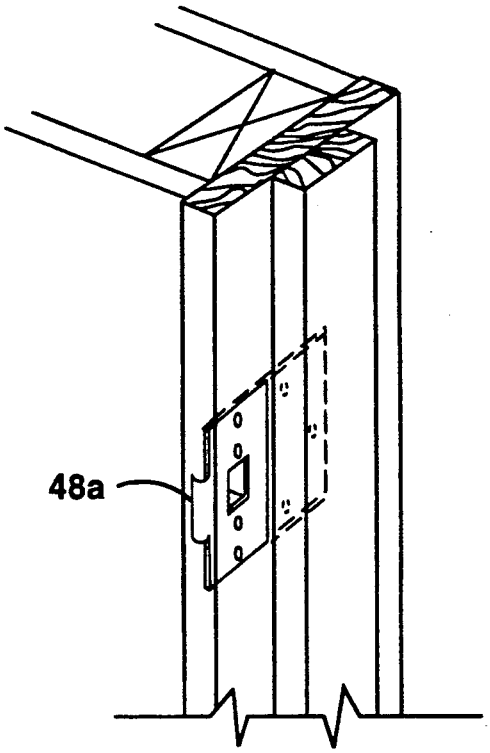
FIG. 6 shows a perspective view of a door jamb strike plate for a cylindrical and/or dead bolt lock.

FIG. 4*a* is an elevation view of a door peep strike plate 48*b*. The elongated aperture 50 in the door peep strike plate 48*b* lets dead bolt travel from point 56*a* to point 56*b* and allows the locked door 20 to open partially. This enables one to see, hear and talk to a person on the outside and pass mail and the like through without unlocking the dead bolt lock 44. A curved portion 54, FIG. 9 of the strike plate 48*b* curves around a trim member 55. This prevents the catching of clothes, etc. on the protrusion and also adds strength to the system. Thus it gives more protection against prize bars, etc. Optional strike plate designs such as those cut at 58 & 60 FIG. 4*a* can be made available. Various shapes or designs can be used without changing effectiveness.

Figure 5A:
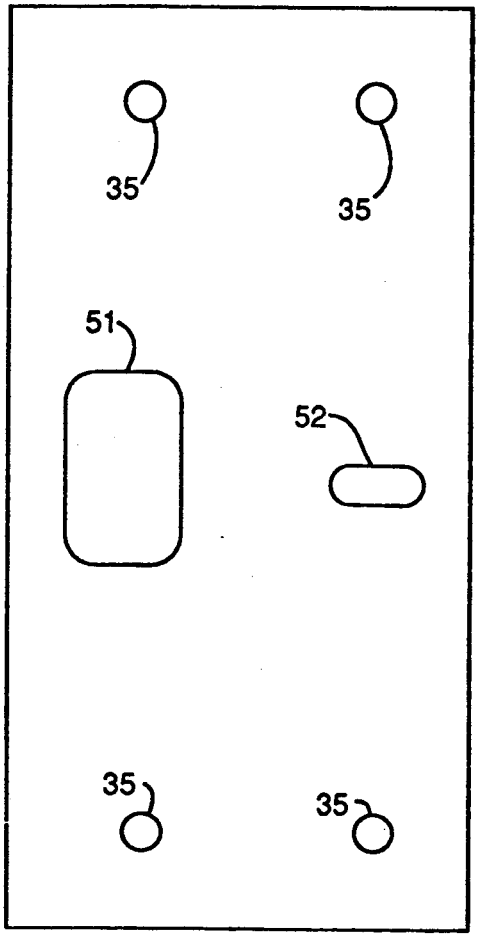
FIG. 5*a* shows an elevation view of the door jamb strike plate for a dead bolt lock.
Figure 6A:
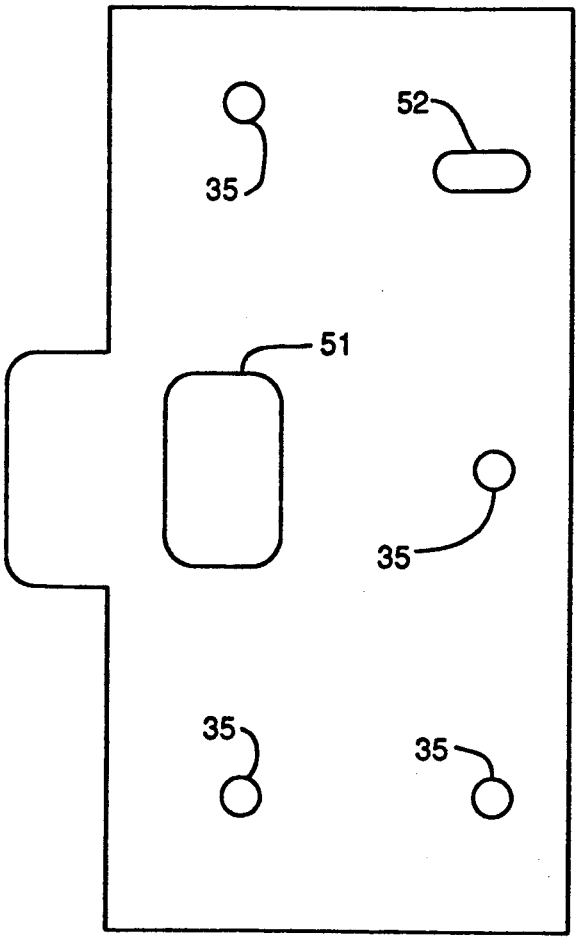
FIG. 6*a* shows an elevation view of the door jamb strike plate for a cylindrical lock and/or deal bolt lock.

FIG. 5*a* & 6*a* show front elevation views of alternate jamb strike plates 48 & 48*a*. FIG. 5*a* is for use with dead bolt locks. FIG. 6*a* is for use with either dead bolt locks or cylindrical locks.

Figure 14A:
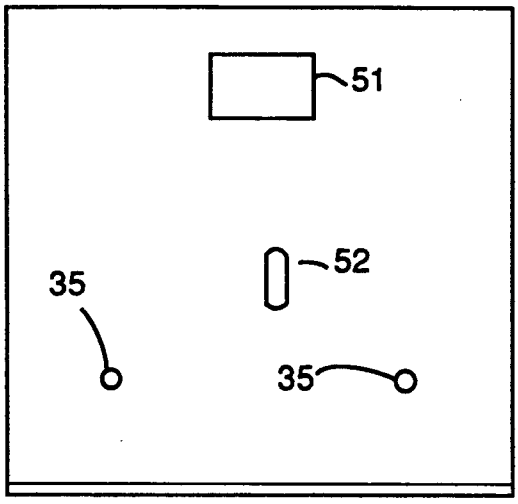
FIG. 14*a* shows a front elevation view of an L-shaped extended strike plate.
Figure 15A:
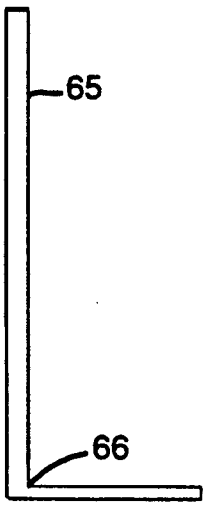
FIG. 15*a* shows a top cross section view of an L-shaped extended strike plate.

In another embodiment shown in FIGS. 14*a* & 15*a* an L-shaped extended strike plate 65 wraps around the jamb 36*a*, FIG. 18, for added strength The plate 65 can be bent at a place such as at 66 when installed to fit various wall thicknesses. That portion of the L wrapped around the exterior trim 68 is secured to the wall with a one-way screw 70. The screws 34 penetrate, not only the door stop 32 and/or jamb 36*a*, but also into the stud 38*a*.

Figure 16:
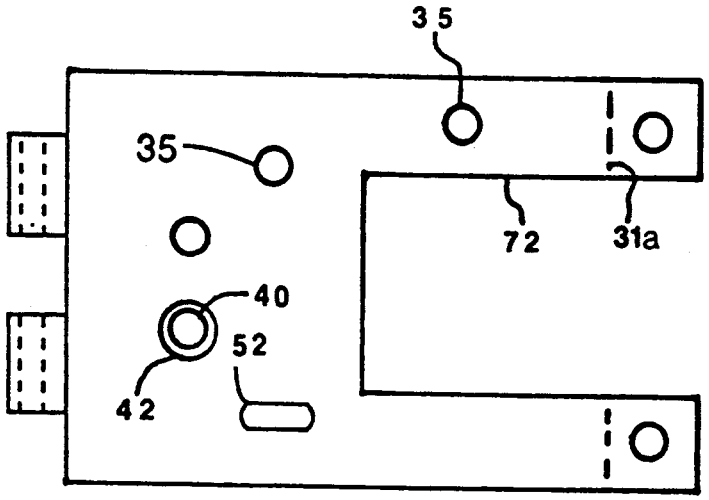
FIG. 16 shows a front elevation view of an extended hinge plate with fingers for adjustment.
Figure 16A:
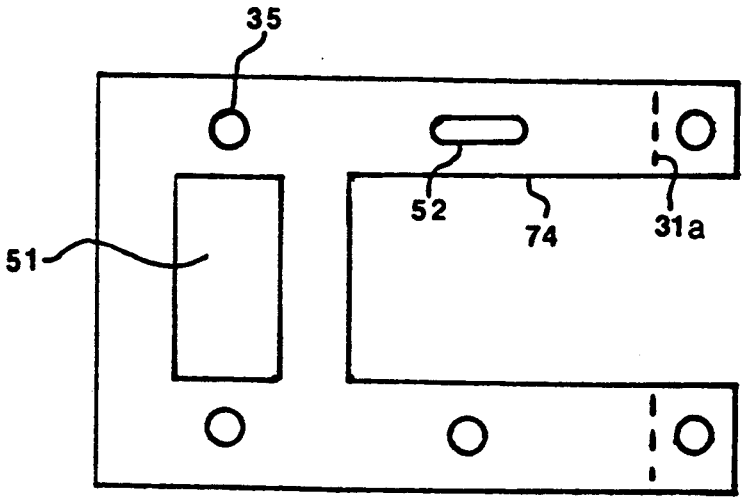
FIG. 16*a* shows a front elevation view of an extended strike plate.
Figure 17:
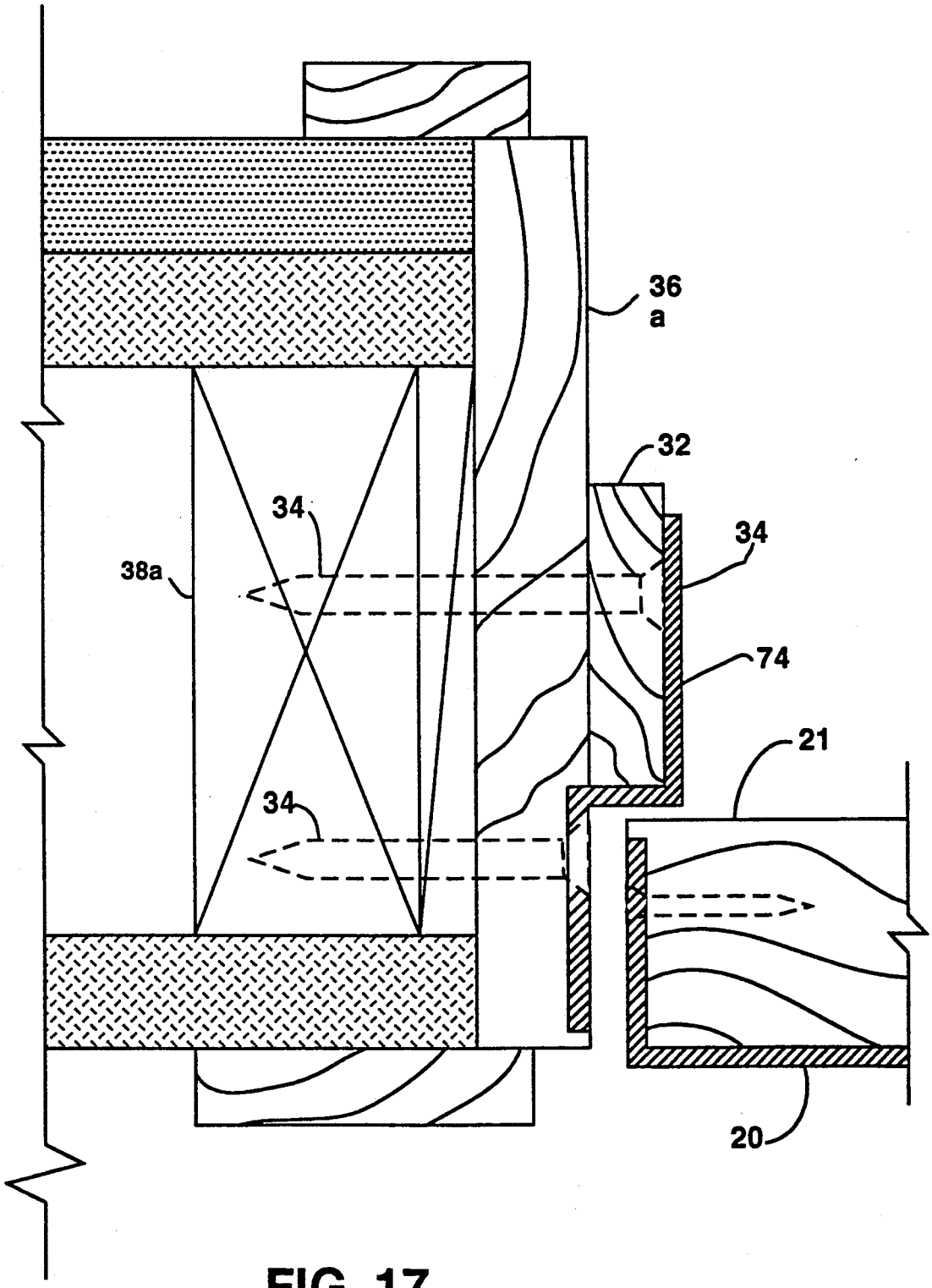
FIG. 17 shows a top cross section view of an extended strike plate with the fingers formed to wrap partially around a door stop on the jamb.

As in FIG. 16*a*, a set of fingers 74 can be easily formed and adjusted on the job so as to fit the individual installation. FIG. 17 shows the plate 74 bent to fit over the door stop 32, rather than having to go under the stop 32 as in FIG. 18.

While not essential to the operation of the Door Secured System, all strike and hinge plates have at least one elongated countersunk screw hole 52 to expedite adjustment during installation.

SUMMARY, RAMIFICATIONS, AND SCOPE

Accordingly, the reader will see that the door secured system of this invention provides a door security system that:

- reinforces and strengthens the jamb on both the lock and the hinge sides.
- reinforces and strengthens the center of the door. This prevents entry by kicking in and then taking furniture through the door.
- stays in full locked secure position while in or away from the dwelling.
- allows a person to open the door far enough to see, hear and talk to the person outside and pass mail and other articles through without unlocking the dead bolt lock.
- is easily and inexpensively installed on new and old door openings by a professional, redi-hung door manufacturer, locksmith, trim man or a do-it-yourselfer.
- can be removed readily and stored out of sight if desired on special occasions, such as parties.
- can be decorated to match the paint or stain of door or decorated with contrasting patterns.
- can be installed on interior doors as well as on exterior entrance doors, protecting against burglary and rape.
- can be applied to cylindrical and dead bolt locks and give the same security for every room within the home.
- may be installed on special doors, such as glazed doors and doors having molding on the surface.
- will give as much or more security without hiding or camouflaging a beautiful and expensive entrance door with an expensive wrought iron door.
- will prevent burglars who enter a building through a relatively unsecured window, or the like, from forcing open the door from the inside and removing valuables.
- is particularly adaptable for hollow core doors, that have little support in their structure.
- is simple in design, inexpensive to manufacture, rugged in construction, easy to use and secure in operation.

Although the description above contains many specificities, these should not be construed as limiting the scope of the invention but as merely providing illustrations of some of the presently preferred embodiments of this invention. For example, the metal member can have other widths and shapes, such as tubular, crimped, beaded, and/or variation in attachment means on both strike and hinge sides, etc. It may be embossed, overlaid with decorative, adhesive backed veneer, vinyl, etc. or embedded in core of door under overlay. It may be painted or stained. It may be fashioned into decorative shapes and forms. It may be made of various metals, such as brass etc.

The peep strike plate can have various heights, widths and shapes, made of various metals also. The protrusion can have corners rounded etc. It may also be laminated, painted etc. to match the decor. The portion of the strike plates and the jamb hinges may be lengthened to wrap around the outside of the jamb, trim or brick mold. The strike plates and jamb hinges may have fingers similar to strap hinges, etc, that can be shaped on the job to fit the individual installation.

Occupants, who do not wish to have the door peep, may have the door secured system installed with an alternate strike plate.

Those who do not want the door reinforcing rigid metal member across the face of the door, may avail themselves of a door with the metal member embedded within, or have abbreviated or short door lock area protective enclosures. These can take various shapes and be made visible or virtually invisible to those inside or outside the house.

For even those residences that have steel doors in wooden frames, our door peep and/or other strike plates and the special hinge system with reinforcing rod will prevent the breaking of the door jambs and trims and also prevent the removal of the door by taking out the hinge pins.

Thus the scope of the invention should be determined by the appended claims and their legal equivalents, rather than by the examples given.

We claim:

1. In combination with an exterior or interior door frame and a door mounted therein having a hinge edge and an opposite lock end, a door secured system that reinforces and strengthens said door at the hinge edge, at the center of said door and at the lock area, that also reinforces and strengthens said door frame on both said lock side and said hinge side, while one is in or out of a dwelling, also allows a person on the inside of said dwelling to open said door far enough to see, hear, talk to a person on the other side, and to pass mail and such articles through opening without unlocking a dead bolt lock or other type lock and without losing any of the maximum security, is removable, said door secured system comprising:

a. a minimum of one reinforcing rigid metal member extending across the width of said door including on a hinge side of said metal member one or more fingers, said finger or fingers formed and arranged so as to partially wrap around a hinge pin, said hinge pin extending above and below a hinge to receive the fingers of said metal member, whereby allowing the member to swing away from the face of said door when removing the member from said door, said metal member further including on a lock side end an angle to fit a strike edge of said door, forming a lock strike plate, said lock strike plate having an aperture allowing a retractable bolt to pass through, said strike plate having keyhole shaped screw holes providing means for attaching the plate to said door, whereby said metal member may be easily removed and replaced, said metal member having a hole distanced from edge of said lock strike plate to fit over various sizes and designs of surface hardware of both dead bolt and cylindrical locks.

b. a hinge securely mounted on said door and on a hinge side jamb, said hinge having an extended plate on said jamb including means for attaching said plate to a stud within a wall, said hinge having an enlarged screw hole in each plate of sufficient size and shape to receive a reinforcing rod, said screw holes having a common horizontal axis through which said reinforcing rod passes when the door is closed, whereby preventing the removal of the door from the inside, even though locked, and even if the hinge pins are removed, said reinforcing rod including a mounting means for securing the rod to said hinge side jamb and also to said stud within said wall, said reinforcing rod having an adjusting means for adjusting the proper depths for penetrating both hinge plates 28 and 30, c. a strike plate securely mounted on a strike side jamb, said strike plate extending along said strike side jamb and including means for anchoring said strike plate to a lock side wall stud, said strike plate having a horizontal elongated aperture to receive said retractable bolt, said elongated aperture permitting the bolt to transverse a distance without unlocking said lock, whereby a person on one side of the door can partially open said door to see, hear, talk and pass mail and like items to a person on the other side of the door with full locked security.

2. The door secured system of claim 1, wherein said metal member is flat and approximately 10 gauge by approximately 6 inches in width, whereby the member can be placed on a surface of said door and also can be placed under a face veneer of a flush door during construction.

3. The door secured system of claim 1 wherein said elongated aperture portion of said strike plate has a shaped protrusion curving back to a door trim, whereby proving additional strength and preventing the snagging of clothes on an otherwise sharp edge.

4. The door secured system of claim 3 further including an alternate rounded shaped edge in lieu of said curved shaped protrusions.

5. The door secured system of claim 1 further including a strike plate having a standard sized and shaped aperture and a return lip easement for pushing back and receiving a cylindrical shaft or for receiving a dead bolt.

6. The door secured system of claim 1 further including an L-shaped extended hinge plate with means for wrapping around outside of said jamb, whereby more securely attaching said plate to said wall of a house.

7. The door secured system of claim 6 wherein said extended hinge plate has an adjustment means to fit various jamb widths.

8. The door secured system of claim 1 further including an extended strike plate mounted across the jamb and wrapping around outside of said jamb.

9. The door secured system of claim 8 wherein said extended strike plate has an adjustment means so as to fit various jamb widths.

10. The door secured system of claim 6 said hinge plate and claim 8 said strike plate further including fingers, said fingers can be formed and adjusted on the job so as to fit the individual installation, said plates containing at least one elongated screw hole to expedite adjustment during installation.

11. The door secured system of claim 1 wherein the metal member is cut at 59, the end near said fingers, with an attaching means to the lock side of the door said member having an engagement means to said reinforcing rod, providing reinforcement to said door and frame from the stud on the hinge side to the stud on the lock side.

* * * * *